US010010166B2

(12) United States Patent
Jimenez

(10) Patent No.: US 10,010,166 B2
(45) Date of Patent: Jul. 3, 2018

(54) ORAL CARE IMPLEMENT WITH COVER MEMBER

(71) Applicant: COLGATE-PALMOLIVE COMPANY, New York, NY (US)

(72) Inventor: Eduardo J. Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 56 days.

(21) Appl. No.: 15/101,922

(22) PCT Filed: Dec. 5, 2013

(86) PCT No.: PCT/US2013/073413

§ 371 (c)(1),
(2) Date: Jun. 5, 2016

(87) PCT Pub. No.: WO2015/084378

PCT Pub. Date: Jun. 11, 2015

(65) Prior Publication Data

US 2016/0302564 A1 Oct. 20, 2016

(51) Int. Cl.
*A46B 11/00* (2006.01)
*A46B 15/00* (2006.01)

(52) U.S. Cl.
CPC ..... *A46B 11/0062* (2013.01); *A46B 11/0086* (2013.01); *A46B 15/0097* (2013.01); *A46B 2200/1066* (2013.01)

(58) Field of Classification Search
CPC ..... A46B 11/0079; A46B 11/0086; A46B 15/0095; A46B 15/0097; A46B 17/00;
(Continued)

(56) References Cited

U.S. PATENT DOCUMENTS 1,690,311 A 11/1928 Reich
1,899,242 A 2/1933 McNab
(Continued)

FOREIGN PATENT DOCUMENTS

CN 201384212 1/2010
DE 4438121 5/1996
(Continued)

OTHER PUBLICATIONS

US 5,724,971, 04/1998, Salinger (withdrawn)
(Continued)

*Primary Examiner* — Jennifer C Chiang
*Assistant Examiner* — Bradley Oliver

(57) ABSTRACT

An oral care implement having a cover member. In one aspect, the invention is an oral care implement comprising: a body comprising a handle and a head, the head comprising a coupling element; a store of oral care material located within the body; an outlet located on the head and in fluid communication with the store; a cover member comprising a cap portion, a mounting portion, and a coupling element; and wherein the cover member is detachably coupled to the head via cooperation between the coupling element of the cover member and the coupling element of the head, and the mounting portion is configured to mount the oral care implement to a vertical surface.

19 Claims, 10 Drawing Sheets

(58) Field of Classification Search
CPC ..... A46B 17/08; A46B 2200/1066; A46B 11/0089; A47K 1/09
See application file for complete search history.

(56) References Cited

U.S. PATENT DOCUMENTS

| | | | | |
|---|---|---|---|---|
| 2,725,270 | A | 11/1955 | Upchurch | |
| 3,325,847 | A | 6/1967 | Meranto | |
| 5,306,151 | A | 4/1994 | Rauch | |
| 6,318,685 | B1 | 11/2001 | Huber | |
| 6,371,674 | B1 * | 4/2002 | Lerner ..... | A46B 11/00 401/137 |
| 6,907,638 | B2 | 6/2005 | Katz | |
| 7,917,986 | B2 | 4/2011 | Jimenez et al. | |
| 8,016,129 | B2 | 9/2011 | Peterson | |
| 8,079,109 | B2 | 12/2011 | Misner et al. | |
| 8,141,563 | B2 | 3/2012 | De Masi, Sr. | |
| 2002/0100134 | A1 | 8/2002 | Dunn et al. | |
| 2007/0114891 | A1 * | 5/2007 | Kim ..... | A46B 17/04 312/207 |
| 2008/0148501 | A1 | 6/2008 | Falk | |
| 2010/0050357 | A1 | 3/2010 | Misner et al. | |
| 2010/0129144 | A1 | 5/2010 | Osborne | |

FOREIGN PATENT DOCUMENTS

| | | |
|---|---|---|
| DE | 20102378 | 10/2001 |
| DE | 10028530 | 12/2001 |
| GB | 2 329 110 | 3/1999 |
| JP | 07-313251 | 12/1995 |
| KR | 20-0467690 | 6/2013 |
| WO | WO 94/27479 | 12/1994 |
| WO | WO 2001/26525 | 4/2001 |

OTHER PUBLICATIONS

International Search Report and the Written Opinion of the International Searching Authority issued in International Patent Application PCT/US2013/073413 dated Jul. 25, 2014.

* cited by examiner

ORAL CARE IMPLEMENT WITH COVER MEMBER

CROSS-REFERENCE TO RELATED PATENT APPLICATIONS

This application is a U.S. national stage application under 35 U.S.C. § 371 of PCT Application No. PCT/US2013/073413, filed Dec. 5, 2013, the entirety of which is incorporated herein by reference.

BACKGROUND

Oral care implements that include dentifrice or other oral care materials in the handle so that the toothbrush and dentifrice can be carried as a single unit are known. In such oral care implements it may be desirable to include a cover or cap in order to prevent the dentifrice from spilling or drying out prior to use thereof. However, oftentimes the cover or cap is only needed during transportation from the manufacturing facility to the stores, and upon being purchased and used by a consumer the cover or cap is simply discarded. Thus, a need exists for an oral care implement having a dual function cover.

BRIEF SUMMARY

Exemplary embodiments according to the present disclosure are directed to an oral care implement having a cover that can be coupled to the head. When coupled to the head the cover seals an outlet and is configured to mount the oral care implement to a vertical surface.

In one aspect, the invention can be an oral care implement comprising: a body comprising a handle and a head coupled to a distal end of the handle, the head comprising a first coupling element, and the handle comprising a second coupling element located at a proximal end of the handle; a store of oral care material located within the body; an outlet located on the head and in fluid communication with the store; a cover member comprising a cap portion, a mounting portion, and a third coupling element; and wherein the cover member is alterable between: (1) a first state in which the first and third coupling elements cooperate with one another to detachably couple the cover member to the head to seal the outlet with the cap portion; and (2) a second state in which the second and third coupling elements cooperate with one another to detachably couple the cover member to the proximal end of the handle so that the mounting portion can operate as a stand to maintain the oral care implement in an upright orientation.

In another aspect, the invention can be an oral care implement comprising: a body comprising a handle and a head coupled to the handle, the body extending along a longitudinal axis from a proximal end to a distal end; a reservoir for containing an oral care material, the reservoir located within the handle; the head having a first surface and a second surface, an outlet located on the second surface of the head and in fluid communication with the reservoir, and a first coupling element located on the second surface of the head; a second coupling element located at the proximal end of the body; a cover member comprising a cap portion, a mounting portion, and a third coupling element, the cover member detachably coupled to the body; and wherein the cover member is alterable between: (1) a first state in which the first and third coupling elements cooperate with one another to detachably couple the cover member to the rear surface of the head; and (2) a second state in which the second and third coupling elements cooperate with one another to detachably couple the cover member to the proximal end of the handle.

In yet another aspect, the invention can be an oral care implement comprising: a body comprising a handle and a head, the head comprising a coupling element; a store of oral care material located within the body; an outlet located on the head and in fluid communication with the store; a cover member comprising a cap portion, a mounting portion, and a coupling element; and wherein the cover member is detachably coupled to the head via cooperation between the coupling element of the cover member and the coupling element of the head, and the mounting portion is configured to mount the oral care implement to a vertical surface.

In a further aspect, the invention can be an oral care implement comprising: a body extending from a proximal end to a distal end, the body comprising a handle and a head, the head having a first surface and an opposing second surface; a coupling element located on the second surface of the head; a reservoir for containing an oral care material, the reservoir located in the handle; an outlet located on the second surface of the head, the outlet in fluid communication with the reservoir; a cover member comprising a cap portion, a mounting portion, and a coupling element; and wherein the cover member is detachably coupled to the second surface of the head via cooperation between the coupling element of the cover member and the coupling element of the head to seal the outlet with the cap portion of the cover member, and wherein the mounting portion is configured to mount the oral care implement to a vertical surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1A:
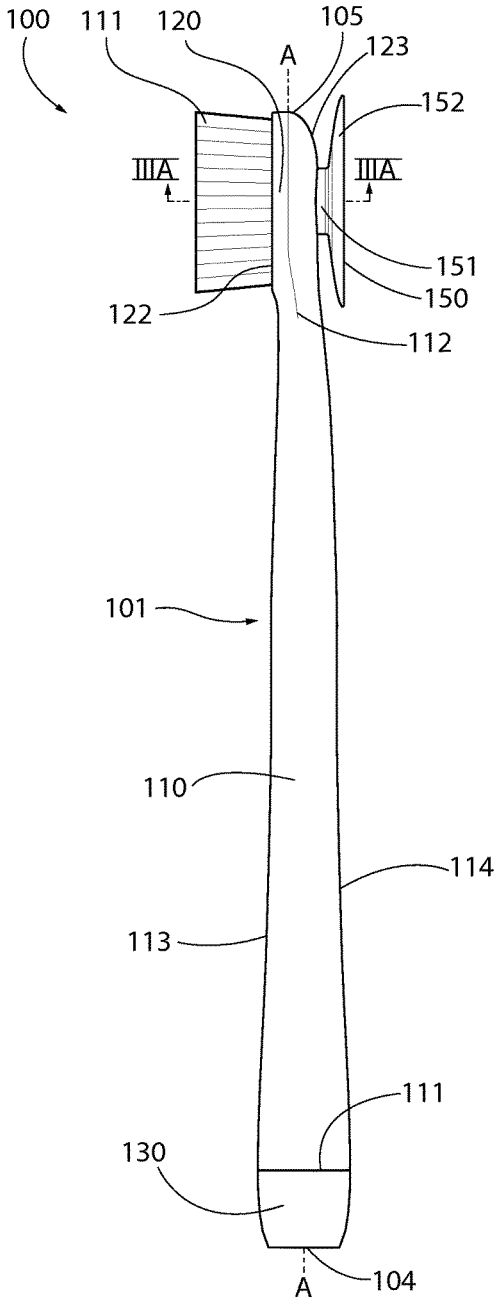
FIG. 1A is a side view of an oral care implement in accordance with a first embodiment of the present invention, wherein a cover member is detachably coupled to a head thereof.
Figure 1B:
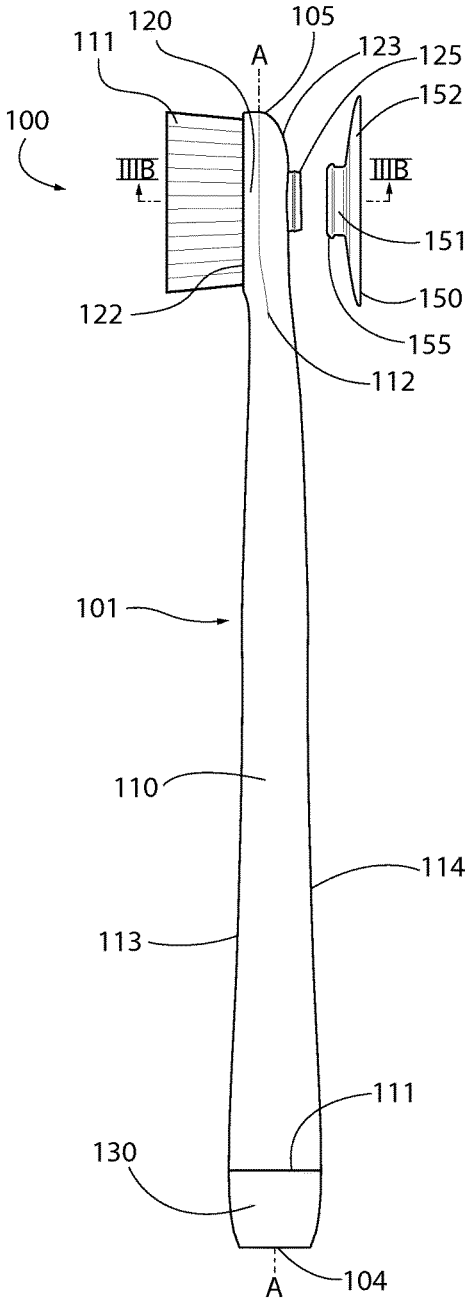
FIG. 1B is a side view of the oral care implement of FIG. 1A wherein the cover member is separated from the head.
Figure 2A:
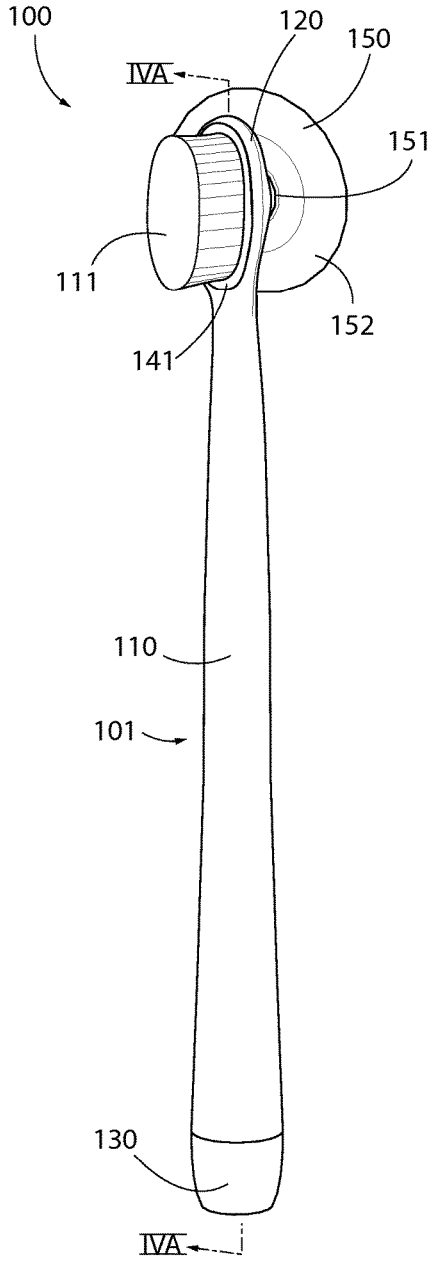
FIG. 2A is a front perspective view of the oral care implement of FIG. 1A.
Figure 2B:
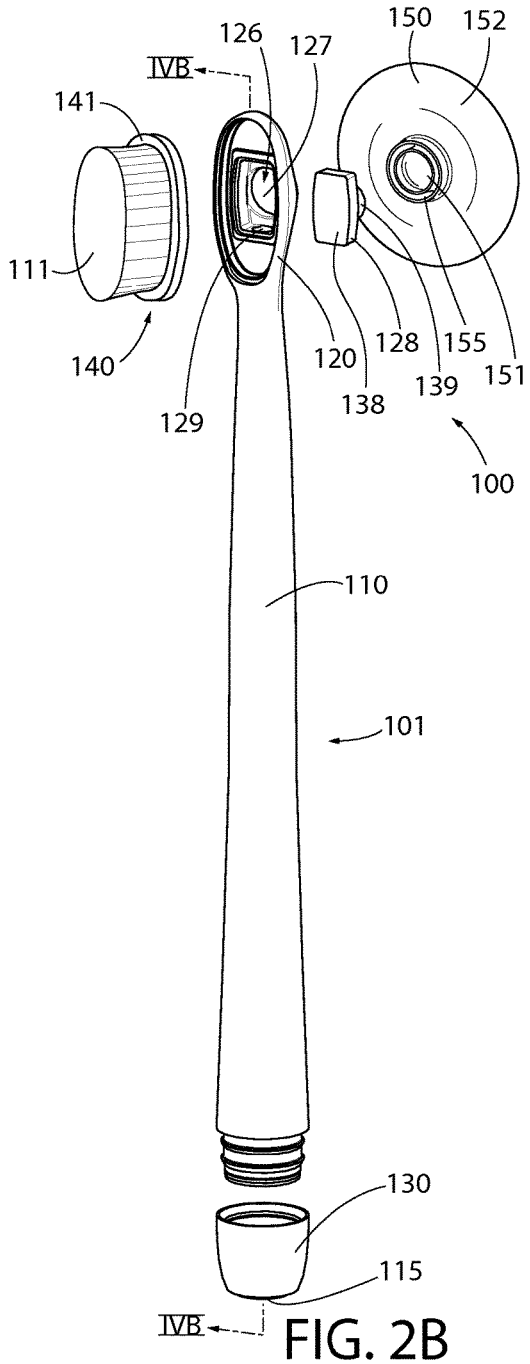
FIG. 2B is an exploded front perspective view of the oral care implement of FIG. 1A.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1A-2B concurrently, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 generally includes a body 101 comprising a handle 110 and a head 120, a cover member 150 that is detachably couplable to both the head 120 and the handle 110 (FIGS. 1A and 5), and an end cap 130. In the exemplified embodiment, the head 120 has a first coupling element 125, the handle 110 has a second coupling element 115 and the cover member 150 has a third coupling element 155. The first and second coupling elements 125, 115 are both capable of cooperation with the third coupling element 155 so that the cover member 150 can be detachably coupled to either the head 120 or the handle 110.

The body 101 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. In such an embodiment, the end cap 130 may form the proximal end 104 of the body 101 and may therefore also comprise the second coupling element 115. The end cap 130 may be detachable from the handle 120 so that an oral care material can be stored within the body 101 (discussed in more detail below with reference to FIGS. 4A and 4B) and can be refilled by detaching the end cap 130 from the handle 110 to provide access to a cavity within the body 101 within which the oral care material may be stored. Furthermore, in certain embodiments the end cap 130 may be altogether omitted.

The handle 110 is an elongated structure that provides the mechanism by which the user can hold and manipulate the oral care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the oral care implement 100 is coupled to the handle 110 and comprises a front surface 122 and an opposing rear surface 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the oral care implement 100 is provided with a plurality of tooth cleaning elements 111 extending from the front surface 122. Furthermore, in the exemplified embodiment the tooth cleaning elements 111 are generically illustrated. In certain embodiments the exact structure, pattern, orientation and material of the tooth cleaning elements 111 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

In the exemplified embodiment, the tooth cleaning elements 111 are formed on a cleaning element assembly 140 that comprises a head plate 141 and the tooth cleaning elements 111 mounted thereon. In such an embodiment, the head plate 141 is a separate and distinct component from the body 101 of the oral care implement 100. However, the head plate 140 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the oral care implement 100.

In certain embodiments, the head plate 141 may comprise a plurality of holes formed therethrough (not illustrated in the figures), and the tooth cleaning elements 111 may be mounted to the head plate 141 within the holes. This type of technique for mounting the tooth cleaning elements 111 to the head 120 via the head plate 141 is generally known as anchor free tufting (AFT). Specifically, in AFT a plate or membrane (i.e., the head plate 141) is created separately from the head 120. The tooth cleaning elements 111 (such as bristles) are positioned into the head plate 141 so as to extend through the head plate 141. The free ends of the bristles on one side of the head plate 141 perform the cleaning function. The ends of the bristles on the other side of the head plate 141 are melted together by heat to be anchored in place. After the bristles are secured to the head plate 141, the head plate 141 is secured to the head 120 such as by ultrasonic welding.

Of course, any suitable form of cleaning elements and attachment may be used in the broad practice of this invention. Specifically, the tooth cleaning elements 111 of the present invention can be connected to the head 120 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the bristles could be mounted to tuft blocks or sections by extending through suitable openings in the tuft blocks so that the base of the bristles is mounted within or below the tuft block.

Although not illustrated herein, in certain embodiments the head 120 may also include a soft tissue cleanser coupled to or positioned on its rear surface 123. An example of a suitable soft tissue cleanser that may be used with the present invention and positioned on the rear surface of the head 120 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Referring now to FIGS. 1A-4B concurrently, the oral care implement 100 will be further described. The body 101 of the oral care implement 100 has an inner surface 106 that defines an internal cavity or reservoir 102 that contains a store of oral care material 103 (see FIGS. 4A and 4B). In the exemplified embodiment, the reservoir 102 is located entirely within the handle 110 of the body 101. However, the invention is not to be so limited in all embodiments and in certain other embodiments the reservoir 102 may be located partially or entirely within the head 120 of the body 101. In the exemplified embodiment, the head 120 of the oral care implement 100 comprises an outlet 126 that is in fluid communication with the store of oral care material 103 located within the reservoir 102. Thus, the oral care material 102 stored within the reservoir 102 can flow from the reservoir 102 and out to a user's oral cavity through the outlet 126.

The oral care material that is stored in the reservoir 102 can be any type of oral care material that is desired to be applied to a user's oral cavity. For example, in one embodiment the oral care material may be a mouthwash. In another embodiment the oral care material may be a dentifrice. In yet another embodiment, the oral care material may be a tooth whitening agent, such as peroxide containing tooth whitening compositions. Other contemplated oral care materials that can be stored in the reservoir 102 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the oral care material can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

As noted above, the oral care implement 100 includes the end cap 130 that is coupled to the proximal end 111 of the handle 110. In the exemplified embodiment, the end cap 130 is coupled to the proximal end 111 of the handle 110 via a threaded screw attachment. Of course, the invention is not to be so limited in all embodiments and in certain other embodiments interference fit, tight fit and other connection techniques can be used to detachably couple the end cap 130 to the handle 110. As illustrated in FIG. 4B, when the end cap 130 is separated from the handle 110, access is provided into the reservoir 102 within the handle 110. Thus, removing the end cap 130 from the handle 110 can enable a user to refill the reservoir 102 with the oral care material 103 or with a different oral care material as needed or desired. Of course, as noted above in other embodiments the end cap 130 may be omitted and in such embodiments upon depleting the oral care material 103 within the reservoir 102, the oral care implement 100 can be used as a conventional toothbrush without the benefits of the oral care material 103, or the oral care implement 100 can be discarded. In certain embodiments, depletion of the oral care material 103 is achieved after a number of uses upon which it is generally desired to dispose of the oral care implement 100, such as for example without limitation after three months of use.

In the exemplified embodiment, the outlet 126 comprises an opening 127 that is formed through the rear surface 123 of the head 120. Furthermore, an applicator 128 is positioned within the opening 127 and is in fluid communication with the reservoir 102. The applicator 128 may be formed of any desired material. For example, in one embodiment the applicator 128 may be formed of a rubber material, such as a thermoplastic elastomer. In such an embodiment the applicator 128 may have a dispensing orifice formed therethrough to enable the oral care material 103 to flow through the applicator 128 for application to a user's oral cavity. In the exemplified embodiment, the applicator 128 is formed of a material that enables the oral care material 103 to flow through the applicator 128 via capillary action, such as for example without limitation foam, a porous plastic, a ceramic, a sponge or any other material with capillary action capabilities and properties. Furthermore, in the exemplified embodiment the applicator 128 is fluidly coupled to a wicking member 129 that extends from the applicator 128 and into the reservoir 102. In such an embodiment, the wicking member 129 may be in direct contact with the oral care material 103 stored within the reservoir 102, and the oral care material 103 may flow through the wicking member 129 to the applicator 128 solely via capillary action. Of course, the invention is not to be so limited in all embodiments and in certain other embodiments passive, mechanical and/or electrical pump systems may be used to force the flow of the oral care material 103 from the reservoir 102 to the applicator 128 for application to a user's oral cavity.

In the exemplified embodiment, the applicator 128 comprises a base portion 138 and a dispensing portion 139. In the exemplified embodiment, the base portion 138 of the applicator 128 has a substantially rectangular shape and the dispensing portion 139 of the applicator 128 has the shape of a dome or half-sphere that protrudes from one of the major surfaces of the base portion 138. In the assembled oral care implement 100 (FIGS. 3A and 4A), the base portion 138 of the applicator 128 is positioned between the head plate 141 and the opening 127 and the dispensing portion 139 of the applicator 128 is positioned within and extends through the opening 127 to enable the dispensing portion 139 of the applicator 128 to contact a user's oral surfaces. Thus, in the exemplified embodiment the base portion 138 of the applicator 128 is in contact with and axially aligned with the wicking member 129 and the dispensing portion 139 of the applicator 128 extends from the base portion 138 of the applicator 128 in a direction substantially transverse to the longitudinal axis A-A. In the exemplified embodiment, there is an empty or air-filled space within the head 120 between the head plate 141 and the base portion 138 of the applicator 128. In certain embodiments, the space between the head plate 141 and the base portion 138 of the applicator 128 may be filled with a support plate to prevent the applicator 128 from moving transversely inward towards the head plate 141 during use. Thus, such a support plate will ensure that the dispensing portion 139 of the applicator 128 always protrudes beyond a terminal end 124 of the first coupling element 125 so that it can be used to apply the oral care material 103 to the user's oral surfaces as desired, as will be better appreciated from the discussion below.

As noted above, the cover member 150, which generally comprises a cap portion 151 and a mounting portion 152, is detachably couplable to the body 101 of the oral care implement 100 in a first state wherein the cover member 150 is attached to the head 120 and a second state wherein the cover member 150 is attached to the handle 110, and the cover member 150 is alterable between the first and second states. In the first state, the cover member 150 can be used to seal the outlet 126 in order to protect the applicator 128 against damage and to prevent leakage of the store of oral care material 103 and in the second state the cover member 150 can be used as a stand for the oral care implement 100 to maintain the oral care implement 100 in an upright orientation.

The coupling of the cover member 150 to the head 120 will be described directly below with reference to FIGS. 1A-4B. The coupling of the cover member 150 to the handle 110 will be described later on in the document with reference to FIGS. 5-7B. It should be understood that the cover member 150 can be attached to and detached from the head 120 repeatedly as desired and the cover member 150 can also be attached to and detached from the handle 110 repeatedly as desired. In the exemplified embodiment, only a single cover member 150 is provided that is attached to either one of the head 120 or the handle 110. In other embodiments, a first cover member may be provided that attaches to the head 120 and a second cover member may be provided that attaches to the handle. In such an embodiment, the first and second cover members may be identical to one another, or they may be different as desired.

In the exemplified embodiment, the first coupling element 125 of the head 120 comprises a third annular wall 134 that extends from the rear surface 123 of the head 120 in a direction that is transverse to the longitudinal axis A-A. As used herein, the term "annular wall" includes a wall structure that is continuous and a wall structure that is discontinuous or formed of several adjacent wall segments. Furthermore, the term "third" is merely used to differentiate the annular wall 134 from other annular walls which will be described below, it being understood that the recitation of the term "third" (and the terms "first," "second" and "third" used below) before the phrase "annular wall" is not to be limiting in any regard. Furthermore, the invention is not to be limited by the first coupling element 125 being an annular wall in all embodiments, and in other embodiments the first coupling element 125 can be any structure that facilitates coupling between the first coupling element 125 and the third coupling element 155 as will be discussed in more detail below.

In the exemplified embodiment, the third annular wall 134 of the first coupling element 125 extends from the rear surface 123 of the head 120 and circumferentially surrounds the outlet 126 and the opening 127. In the assembled oral care implement 100, the third annular wall 134 of the first coupling element 125 also circumferentially surrounds the dispensing portion 139 of the applicator 128. More specifically, the third annular wall 134 of the first coupling element 125 circumferentially surrounds a first portion 161 of the dispensing portion 139 of the applicator 128 and a second portion 162 of the dispensing portion 139 of the applicator 128 extends beyond the terminal end 124 of the third annular wall 134 of the first coupling element 125. This enables the second portion 162 of the dispensing portion 139 of the applicator 128 to contact a user's oral surfaces unimpeded by the first coupling element 125. In the exemplified embodiment, a gap 163 is provided between the third annular wall 134 of the first coupling element 125 and the applicator 128 to facilitate coupling of the cover member 150 to the rear surface 123 of the head 120 as will be discussed in more detail below.

As noted above, the cover member 150 comprises a mounting portion 152 and a cap portion 151. In the exemplified embodiment, the cover member 150 is a single unitary structure. However, the invention is not to be so limited in all embodiments and in certain other embodiments the mounting portion 152 and the cap portion 151 of the cover member 150 can be two separate components that are operably or mechanically coupled together.

The mounting portion 152 of the cover member 150 is a dish-shaped (or dome-shaped) structure comprising an inner surface 153 and an outer surface 154. The inner surface 153 of the mounting portion 152 of the cover member 150 is concave and the outer surface 154 of the mounting portion 152 of the cover member 150 is convex. The cap portion 151 of the cover member 150 extends from the convex outer surface 154 of the mounting portion 152 of the cover member 150. More specifically, the cap portion 151 of the cover member 150 comprises a first annular wall 164 that extends from the outer surface 154 of the mounting portion 152 and a floor 165. Although illustrated as being an annular wall, the cap portion 151 of the cover member 150 need not be annular in all embodiments. The first annular wall 164 and the floor 165 of the cap portion 151 of the cover member 150 collectively define a cavity 166 that protects the applicator 128 against damage when the cover member 150 is coupled to the rear surface 123 of the head 120 as discussed in more detail below. The floor 165 of the cap portion 151 of the cover member 150 has a concave shape that corresponds with the shape of a terminal end 169 of the dispensing portion 139 of the applicator 128, and more specifically with the shape of the terminal end 169 of the second portion 162 of the dispensing portion 139 of the applicator 128. These corresponding shapes facilitate the cap portion 151 of the cover member 150 providing protection to the applicator 128 when the cover member 150 is coupled to the head 120 and also minimizes the amount of space that is taken up by the combined head 120 and cover member 150.

As noted above, the cover member 150 comprises the third coupling element 155. In the exemplified embodiment, the third coupling element 155 comprises a second annular wall 159 that extends from the outer surface 154 of the mounting portion 152 of the cover member 150. More specifically, the second annular wall 159 circumferentially and/or concentrically surrounds the first annular wall 164 of the cap portion 151 of the cover member 150 and is spaced from the first annular wall 164 of the cap portion 151 of the cover member 150 by an annular gap 167. Of course, the invention is not to be so limited in all embodiments and in certain other embodiments the third coupling element 155 may merely be a protruding structure without being annular. In embodiments that the coupling element 155 is an annular wall, such annular wall may be a single continuous wall segment or multiple wall segments that are positioned adjacent to one another.

In still other embodiments the cap portion 152 of the cover member 150 may comprise a coupling element such that the third coupling element 155 may be omitted. Specifically, the cover member 150 may be coupled to the rear surface 123 of the head 120 by an interference fit with the cap portion 151 of the cover member 150 being positioned within the gap 163 between the first coupling element 125 and the applicator 128. Stated another way, in certain embodiments the second annular wall 159 may be omitted and the first annular wall 164 may serve the dual function of protecting the applicator 128 and of coupling the cover member 150 to the head 120.

The cover member 150 may be detachably coupled to the rear surface 123 of the head 120 so that the cap portion 151 of the cover member 150 encloses the applicator 128 and protects the applicator 128 against damage and leakage/drying out when the applicator 128 is not in use. Specifically, to couple the cover member 150 to the rear surface 123 of the head 120, the first annular wall 164 of the cap portion 151 of the cover member 150 is aligned with the gap 163 between the applicator 128 and the first coupling element 125 and the third annular wall 134 of the first coupling element 125 of the head 120 is aligned with the gap 167 between the first and second annular walls 164, 159. Then, the cover member 150 is moved or pressed towards the rear surface 123 of the head 120 until the first annular wall 164 of the cap portion 151 of the cover member 150 is positioned in the gap 163 between the applicator 128 and the third annular wall 134 of the first coupling element 125. Furthermore, when the cover member 150 is coupled to the head 120, the third annular wall 134 of the first coupling element 125 is positioned in the annular gap 167 between the first annular wall 164 of the cap portion 151 of the cover member 150 and the second annular wall 159 of the third coupling element 155. In the exemplified embodiment, the first annular wall 164 of the cap portion 151 has a first internal diameter $D_1$, the third annular wall 134 of the first coupling element 125 has a second internal diameter $D_2$, and the second annular wall 159 of the third coupling element 155 has a third internal diameter $D_3$ such that the third internal diameter $D_3$ is greater than the second internal diameter $D_2$ and the second internal diameter $D_2$ is greater than the first internal diameter $D_1$.

In the exemplified embodiment, an inner surface 180 of the third coupling element 155 comprises a notch 181 and a flange 182 that cooperate with a similar notch 183 and flange 184 that are formed on an outer surface 185 of the first coupling element 125. Specifically, as the cover member 150 is moved towards the rear surface 123 of the head 120, the flange 182 of the third coupling element 155 and the flange 184 of the first coupling element 125 slide passed each other. The flanges 182, 184 may be able to slide passed each other due to the third coupling element 155 flexing outwardly away from the first coupling element 125 during this movement. After the flanges 182, 184 pass each other, the flange 182 of the third coupling element 155 nests within the notch 183 of the first coupling element 125 and the flange 184 of the first coupling element 125 nests within the notch 181 of the third coupling element 155. In this regard, the exemplified embodiment allows for a snap-fit connection between the first and third coupling elements 125, 155.

However, the invention is not to be so limited in all embodiments, and in certain other embodiments the connection between the first and third coupling elements 125, 155 can be achieved by a threaded connection, a tight-fit connection, an interference fit connection or any other type of mechanical connection. For example, in certain embodiments the notches and flanges are omitted and the coupling elements may have smooth inner and outer surfaces. However, an interference or tight fit connection is achieved by sandwiching the first coupling element 125 between the third coupling element 155 and the cap portion 151 and by sandwiching the cap portion 151 between the first coupling element 125 and the applicator 128. In another embodiment, the inner surface of the third coupling element 155 may include threads that correspond with threads on the outer surface of the second coupling element 125 to facilitate a threaded screw coupling between the cover member 150 and the head 120.

Figure 3A:
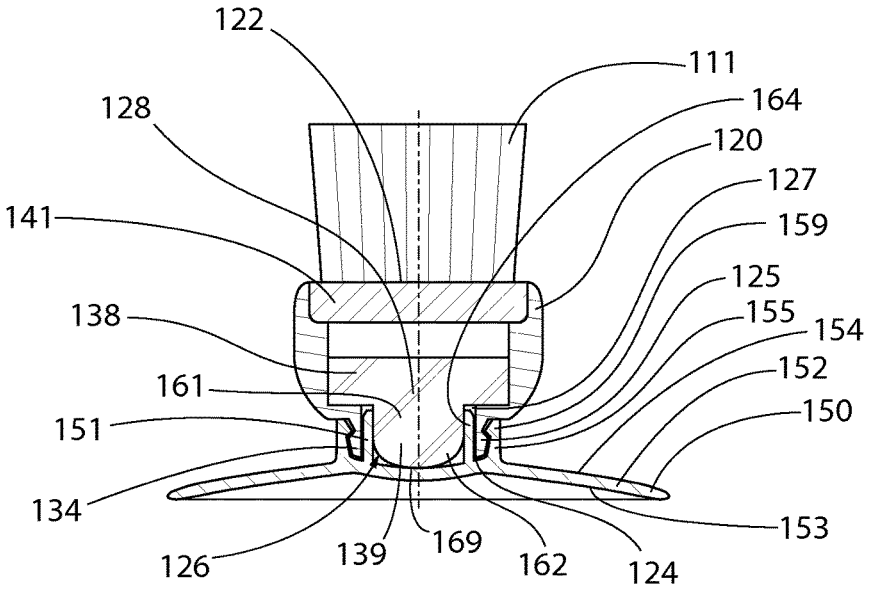
FIG. 3A is a cross-sectional view taken along line IIIA-IIIA of FIG. 1A
Figure 3B:
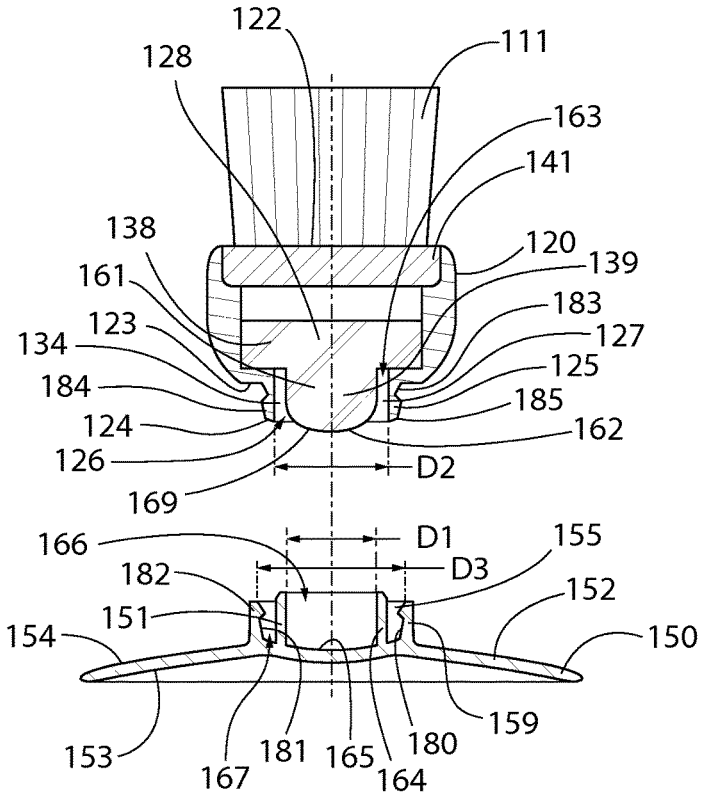
FIG. 3B is a cross-sectional view taken along line IIIB-IIIB of FIG. 1B.
Figure 4A:
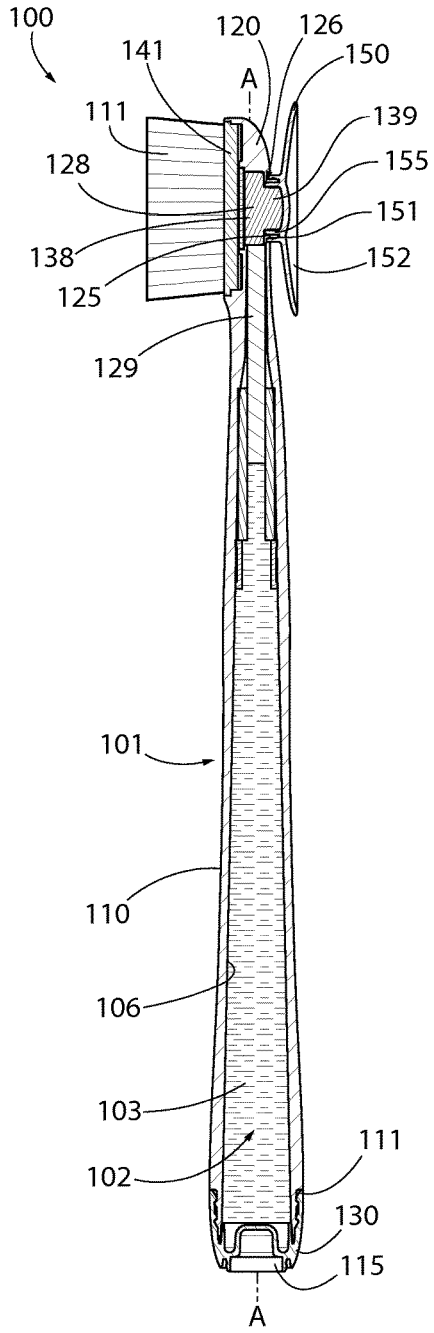
FIG. 4A is a cross-sectional view taken along line IVA-IVA of FIG. 2A.
Figure 4B:
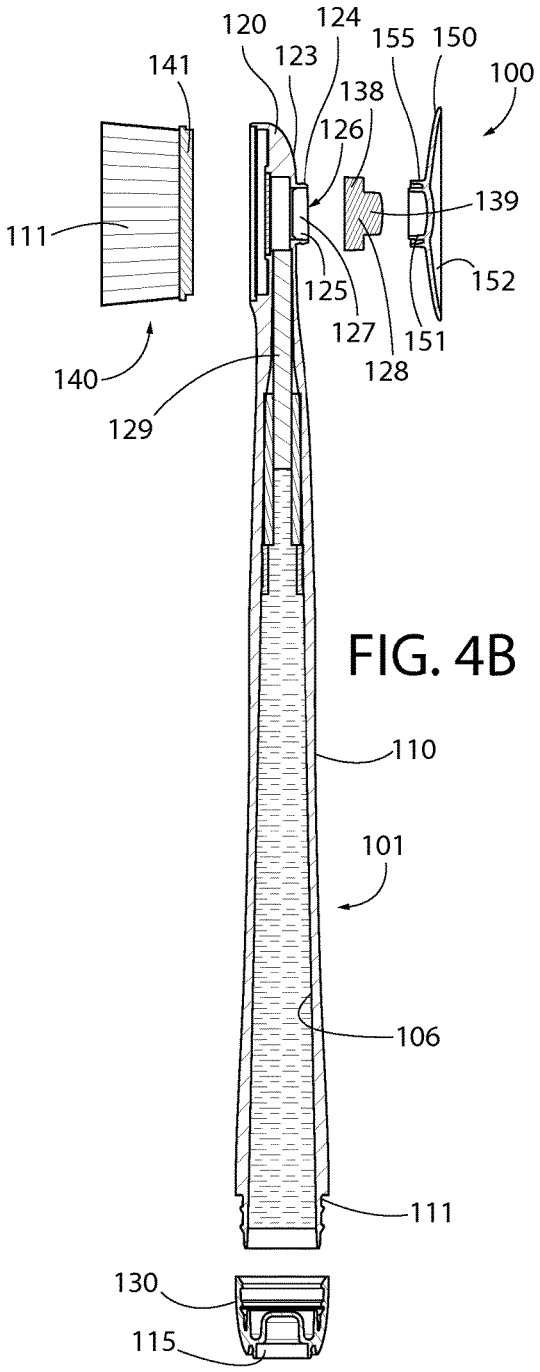
FIG. 4B is a cross-sectional view taken along line IVB-IVB of FIG. 2B.

FIGS. 3A and 4A illustrate the cover member 150 in the first state in which the first and third coupling elements 125, 155 cooperate with one another to detachably couple the cover member 150 to the head 120 to seal the outlet 126 with the cap portion 151 of the cover member 150. More specifically, in the first state the cap portion 151 of the cover member 150 encloses the applicator 128 as discussed above. The shape of the floor 165 of the cap portion 151 corresponds with the shape of the terminal end 169 of the applicator 128 to ensure that the cap portion 151 adequately protects the applicator 128 and to minimize the space taken up by the head 120 and cover member 150. When the cover member 150 is in the first state, the cover member 150 only covers the applicator 128 on the rear surface 123 of the head 120 and the tooth cleaning elements 111 remain uncovered by the cover member 150 and therefore exposed. Thus, in the exemplified embodiment the cover member 150 is not intended to protect the tooth cleaning elements 111, but rather to protect the applicator 128 and to seal the outlet 126. Furthermore, when the cover member 150 is in the first state, the concave outer surface 154 of the mounting portion 152 of the cover member 150 faces the rear surface 123 of the head 120.

When the cover member 150 is in the first state, the oral care implement 100 may be positioned on a horizontal surface such that the mounting portion 152 of the cover member 150 is in contact with the horizontal surface. In such a state, the oral care implement 100 rests on the horizontal surface such that the longitudinal axis A-A of the body 101 is substantially parallel with the horizontal surface. In this state/position, the tooth cleaning elements 111 will remain upright and spaced from the horizontal surface so that the tooth cleaning elements 111 will not get contaminated by contacting a dirty surface. For example, the mounting portion 152 of the cover member 150 may be placed into contact with a countertop in a bathroom and the oral care implement 100 can be positioned along the countertop surface. The mounting portion 152 of the cover member 150 maintains the oral care implement 100 in a position such that the tooth cleaning elements 111 do not contact the countertop surface while at the same time the cap portion 151 of the cover member 150 protects the applicator 128 against direct contact with the countertop surface. The mounting portion 152 is sturdy due to its dish-like shape and does not allow the oral care implement 100 to be easily rotated about the longitudinal axis A-A, which prevents the tooth cleaning elements 111 from contacting the countertop surface.

The cover member 150 is alterable between the first state in which the first and third coupling elements 125, 155 cooperate with one another to detachably couple the cover member 150 to the head 120 and the second state in which the second and third coupling elements 125, 155 cooperate with one another to detachably couple the cover member 150 to the proximal end 104 of the body 101. In the first state, the cap portion 151 of the cover member 150 encloses and protects the applicator 128 and in the second state the mounting portion 152 of the cover member 150 can operate as a stand to maintain the oral care implement 100 in an upright orientation. The cover member 150 has been discussed above with regard to the first state. The cover member 150 can be altered into and out of the first state by pressing the cover member 150 into contact with the rear surface 123 of the head 120 and pulling the cover member 150 in a direction away from the rear surface 123 of the head 120.

Referring now to FIGS. 5-7B concurrently, the coupling of the cover member 150 to the proximal end 104 of the body 101 so that the cover member 150 can operate as a stand will be described. Certain features of the oral care implement 100 will be numbered in FIGS. 5-7B but not described in detail in the interest of brevity, it being understood that the description of those features above with regard to FIGS. 1A-4B applies.

Figure 5:
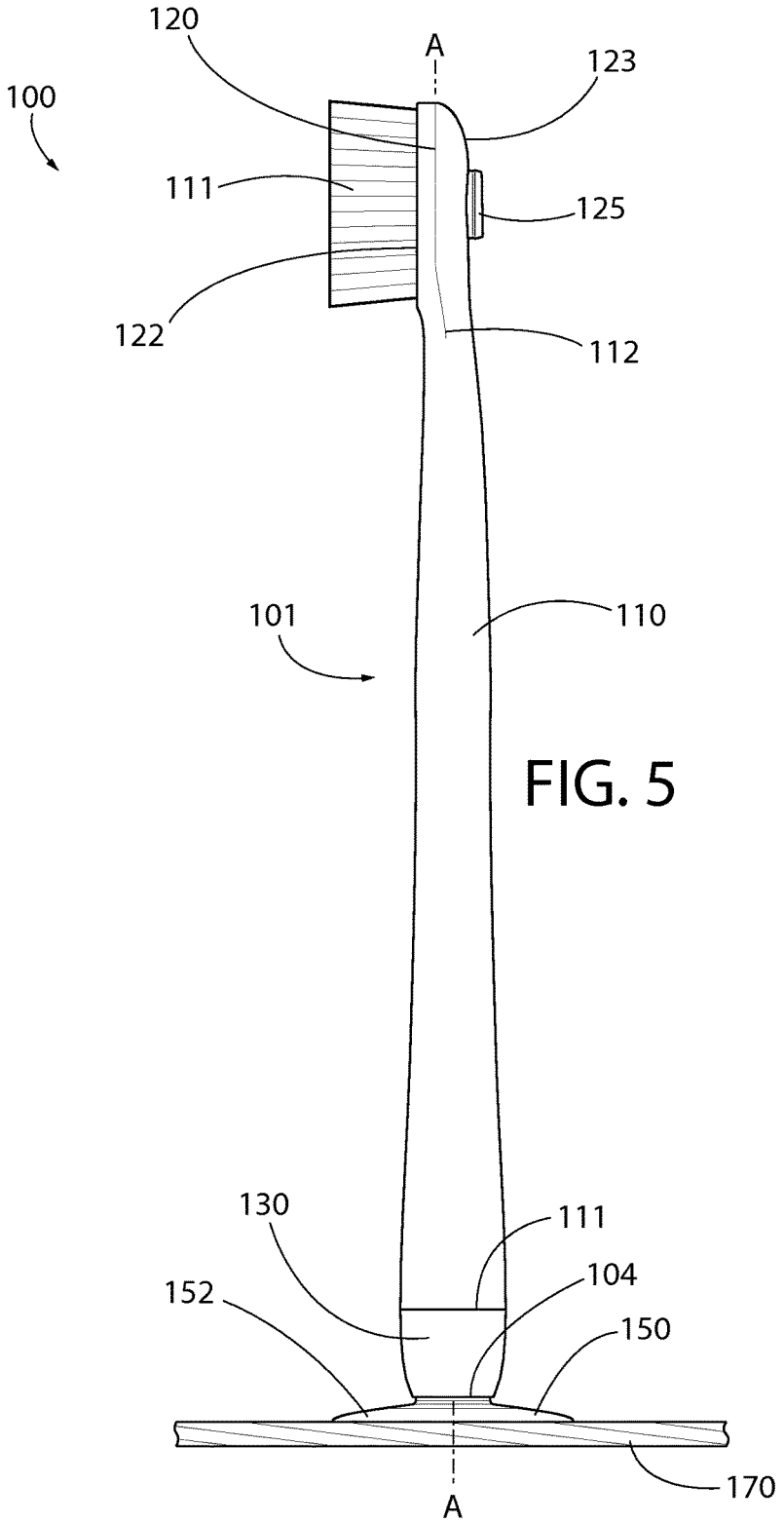
FIG. 5 is a side view of the oral care implement of FIG. 1A wherein the cover member is detachably coupled to a handle thereof and positioned on a support surface.
Figure 6A:
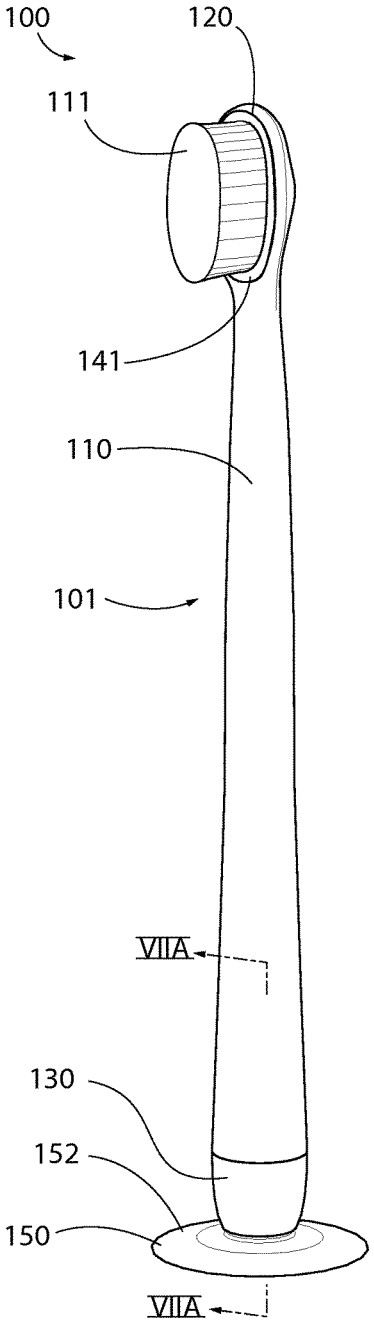
FIG. 6A is a front perspective view of the oral care implement of FIG. 5.
Figure 6B:
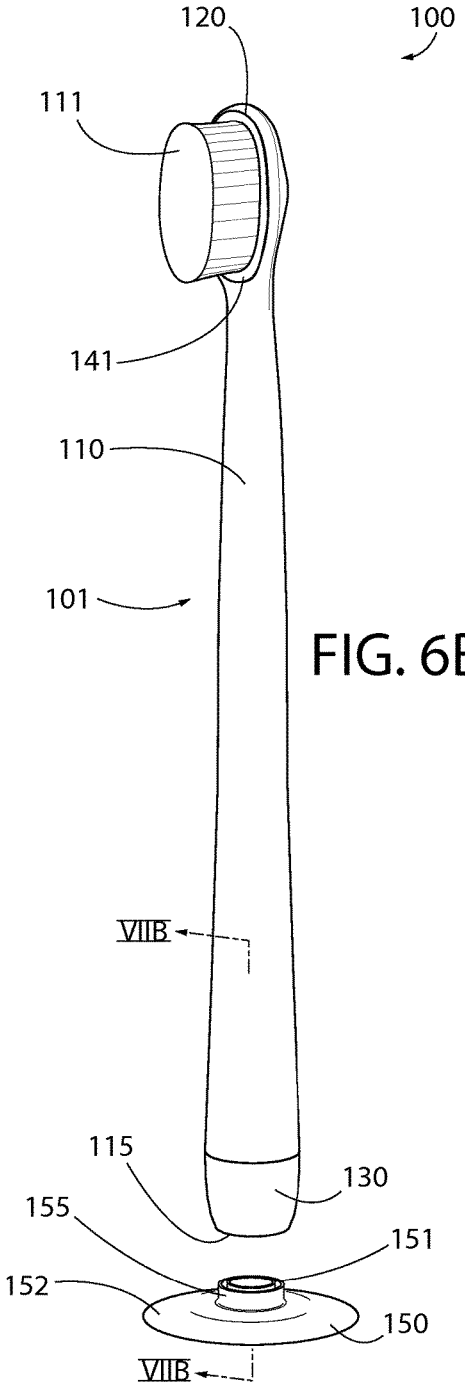
FIG. 6B is a front perspective view of the oral care implement of FIG. 5 wherein the cover member is separated from the handle.
Figure 7A:
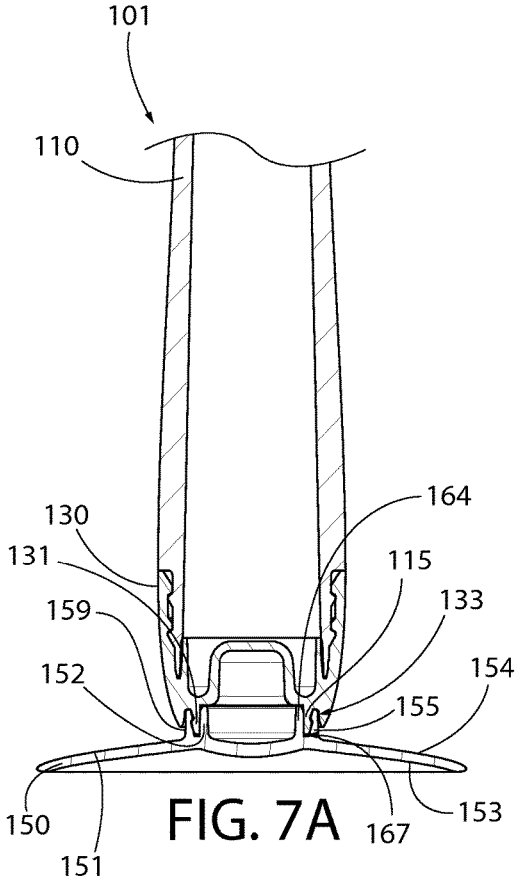
FIG. 7A is a cross-sectional view taken along line VIIA-VIIA of FIG. 6A.
Figure 7B:
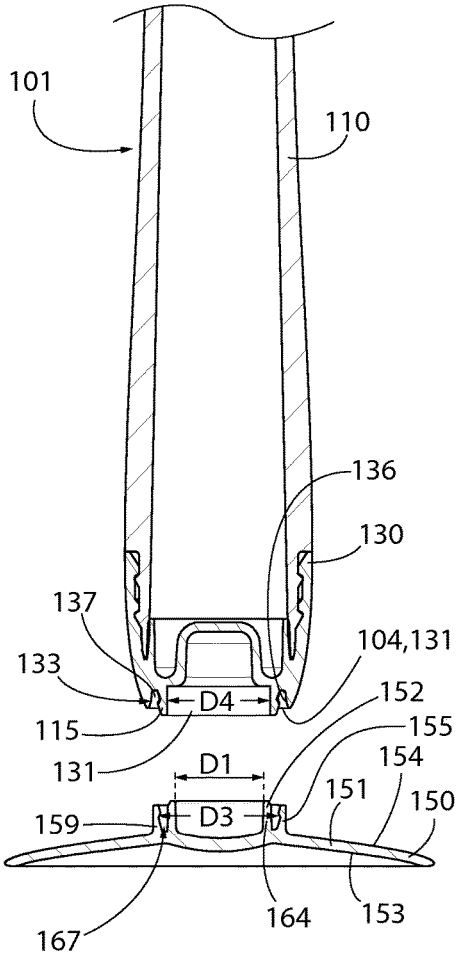
FIG. 7B is a cross-sectional view taken along line VIIB-VIIB of FIG. 6B.

In FIG. 5, the cover member 150 is illustrated as being coupled to the proximal end 104 of the body 101 and the mounting portion 152 of the cover member 150 is positioned on a horizontal support surface 170. The same cover member 150 that was discussed above as being coupled to the rear surface 123 of the head 120 is now coupled to the proximal end 104 of the body 101. Thus, in FIG. 5 the first coupling element 125 of the head 120 is visible and exposed and is not covered by the cover member 150. Furthermore, as can be seen, the tooth cleaning elements 111 are uncovered and exposed when the cover member 150 is in the second state. Thus, the tooth cleaning elements 111 are uncovered and exposed when the cover member 150 is in either of the first and second states.

When the cover member 150 is in the second state such that the cover member 150 is coupled to the proximal end 104 of the body 101, the cover member 150 is able to operate as a stand and maintain the oral care implement 100 in an upright orientation. Specifically, when the cover member 150 is in the second state and the mounting portion 152 of the cover member 150 is positioned on a horizontal support surface, the oral care implement 100 is maintained in the upright orientation such that the longitudinal axis A-A of the body is substantially perpendicular to the horizontal support surface 170. The oral care implement 101 can be maintained in this upright orientation in part because the center of gravity of the oral care implement 100 is located within the bounds of a reference cylinder extending from the perimeter of the mounting portion 152 of the cover member 150 in the direction of the longitudinal axis A-A.

Referring to FIGS. 6A through 7B, the oral care implement 100 will be further described with regard to the cover member 150 being in the second state. As discussed above, the handle 110 of the oral care implement 100 has a second coupling element 115 that cooperates with the third coupling element 155 of the cover member 150 in order to detachably couple the cover member 150 to the proximal end 104 of the body 101. Specifically, in the exemplified embodiment the second coupling element 115 is formed on the end cap 130. However, in embodiments wherein the end cap 130 is omitted, the second coupling element 115 can be formed directly on the handle 110 of the oral care implement 101.

In the exemplified embodiment, the second coupling element 115 comprises a fourth annular wall 131 that extends from a proximal end 132 of the end cap 130 (which is also the proximal end 104 of the body 101). Although depicted as an annular wall, the invention is not to be so limited in all embodiments and in certain other embodiments the second coupling element 115 can be other structures that facilitate cooperation between the second coupling element 115 and the third coupling element 155. Furthermore, in certain embodiments the annular wall may be a single continuous wall segment, and in other embodiments the annular wall may be formed by multiple wall segments that are positioned adjacent to one another. In the exemplified embodiment, the proximal end 104, 132 of the body 101 and/or end cap 130 has a recess or dimple 137 and the fourth annular wall 131 extends from the recess 137 at a location that is set inwardly from an inner surface 136 of the end cap 130 that surrounds the recess 137. Thus, an annular gap 133 is formed between the annular wall 131 and the inner surface 136 of the end cap 130.

Thus, using the above structure, the cover member 150 can be coupled to the proximal end 104 of the body 101 as follows. The cover member 150 can be aligned with the body 101 so that the fourth annular wall 131 of the second coupling element 115 is axially aligned with the annular gap 167 located between the first annular wall 164 of the cap portion 151 and the second annular wall 159 of the third coupling element 155. Simultaneously, the second annular wall 159 of the third coupling element 155 is axially aligned with the annular gap 133 between the fourth annular wall 131 and the inner surface 136 of the end cap 130 (see FIG. 7B). Next, the cover member 150 is moved axially towards the proximal end 104 of the body 101 until the fourth annular wall 131 of the second coupling element 115 is positioned within the annular gap 167 and the second annular wall 159 of the third coupling element 155 is located within the annular gap 133. The second coupling element 115 may include a flange and a notch as discussed above with regard to the first coupling element 125 in order to facilitate a snap-fit connection between the second and third coupling elements 115, 155, although this is not necessary in all embodiments.

Thus, in essentially the same manner, the cover member 150 can be coupled to the head 120 or to the handle 110, and more specifically the third coupling element 155 of the cover member 150 can be made to cooperate with either one of the first coupling element 125 of the head 120 and the second coupling element 115 of the handle 110. The cooperation between the second and third coupling elements 115, 155 is substantially the same as the cooperation between the first and third coupling elements 115, 155, and can be achieved via any one of a snap-fit connection, a threaded connection, a tight-fit connection and an interference-fit connection as desired. However, when the cover member 150 is in the first state, the third coupling element 155 is visible from a side profile of the oral care implement 200 (see FIG. 1A) because the third coupling element 155 surrounds the first coupling element 125. Differently, when the cover member 150 is in the second state, the coupling element 155 is not visible from a side profile of the oral care implement 100 (see FIG. 5) because the end cap 130 surrounds the third coupling element 155.

In the exemplified embodiment, the fourth annular wall 131 has a fourth internal diameter $D_4$, and the fourth internal diameter $D_4$ is substantially the same (or exactly the same in some embodiments) as the second internal diameter $D_2$ of the third annular wall 134. This similarity in the second and fourth internal diameters $D_2$, $D_4$ enables the same cooperation to take place between the third coupling element 155 and each of the first and second coupling elements 125, 115. Thus, because the same cover member 150 can be coupled to both the rear surface 123 of the head 120 and the proximal end 104 of the body 101, the cover member 150 is a dual function component in that it can protect the applicator 128 during transport, storage and sale and can be used as a stand after purchase by a consumer.

Referring now to FIGS. 8-10B, an oral care implement 200 is illustrated in accordance with an alternative embodiment of the present invention. The oral care implement 200 is similar to the oral care implement 100 in many respects, and thus similar features will be similarly numbered except that the 200-series of numbers will be used. Certain features of the oral care implement 200 may be similarly numbered as the oral care implement 100 but might not be described in detail herein in the interest of brevity, it being understood that the discussion of the similar component on the oral care implement 100 applies. Furthermore, features of the oral care implement 100 described above that are not illustrated on the oral care implement 200 are applicable to the oral care implement 200 in certain embodiments and vice versa. Thus, various combinations of the description below with regard to the oral care implement 200 and the description above with regard to the oral care implement 100 are within the scope of the present invention in some embodiments.

The oral care implement 200 comprises a body 201 comprising a handle 210 and a head 220. One of the differences between the oral care implement 200 and the oral care implement 100 is that the oral care implement 200 does not have a coupling element on the handle 210 of the body 200. Rather, the proximal end 204 of the body 201 is formed in a conventional manner. Thus, the cover member 250 is detachably couplable to the head 220 in a similar manner as has been discussed above with regard to the cover member 150 and the head 120, but the cover member 250 is not also detachably couplable to the handle 220. Of course, the invention is not to be so limited in all embodiments and in certain other embodiments the proximal end 204 of the body 201 may include a coupling element such as the coupling element 115 described above with reference to the oral care implement 100. Furthermore, in the oral care implement 200 the cover member 250 comprises two separate components that are detachable from one another. These differences will be better understood from the discussion of FIGS. 8-10B that follows.

Figure 8:
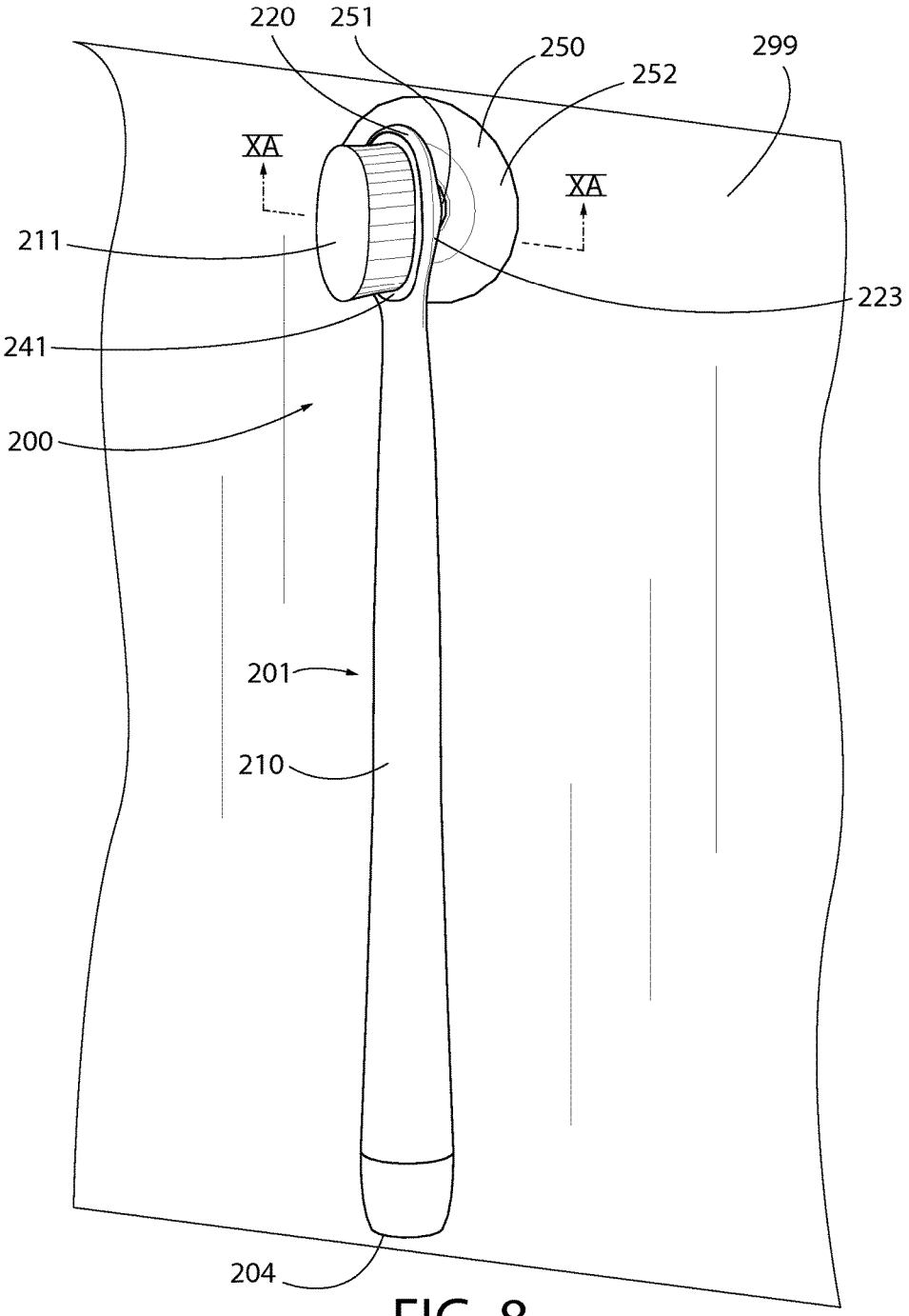
FIG. 8 is a front perspective view of an oral care implement in accordance with a second embodiment of the present invention, wherein a cover member is detachably coupled to a head thereof and wherein the oral care implement is mounted to a vertical surface.
Figure 9:
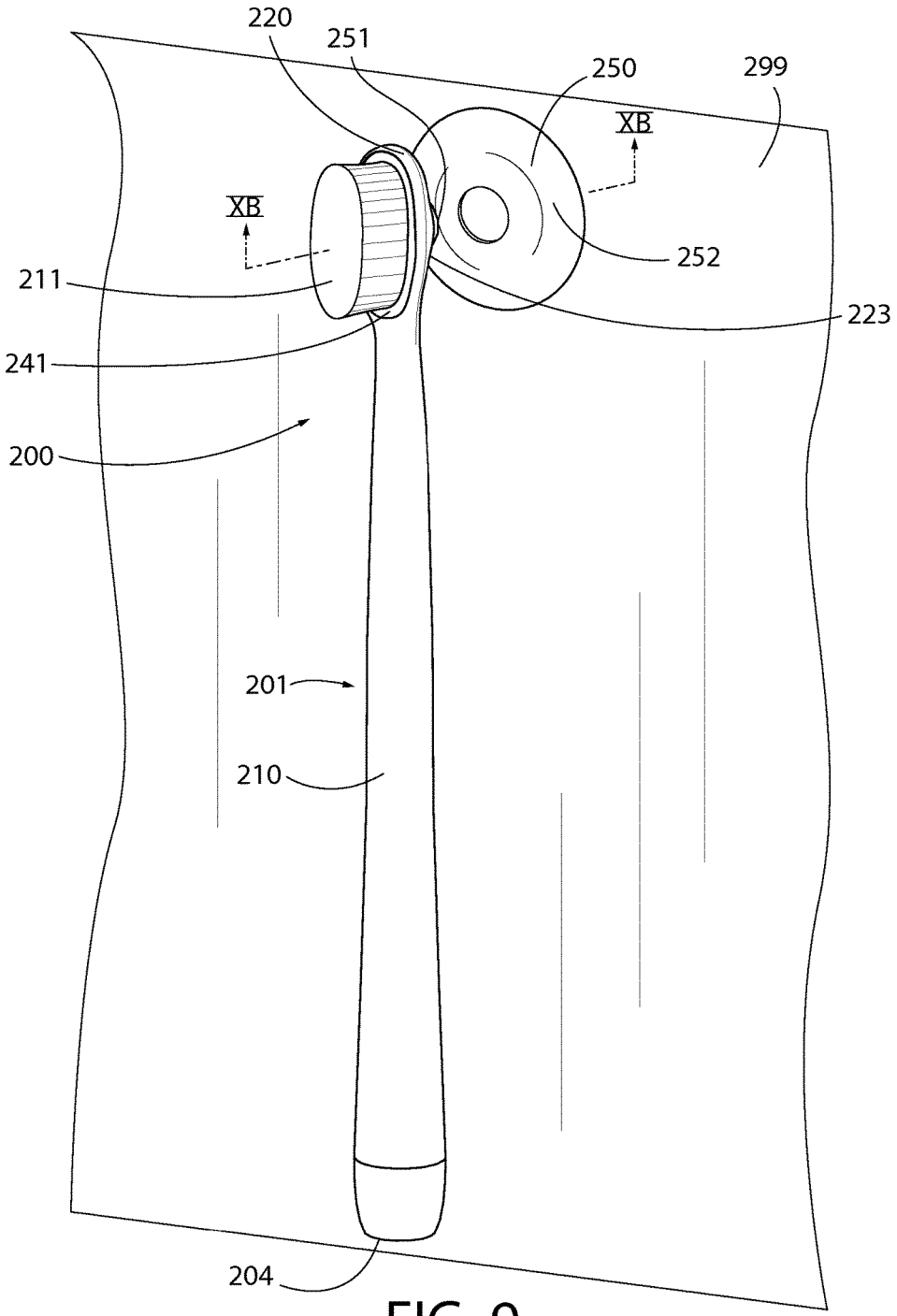
FIG. 9 is a front perspective view of the oral care implement of FIG. 8 wherein the cover member is attached to the vertical surface and the oral care implement is separated from the cover member.
Figure 10A:
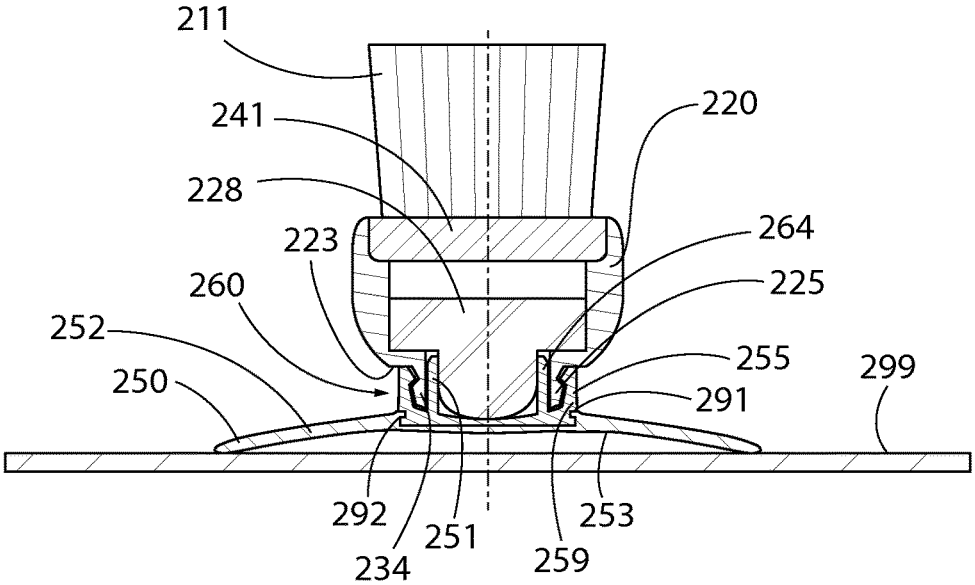
FIG. 10A is a cross-sectional view taken along line XA-XA of FIG. 8.
Figure 10B:
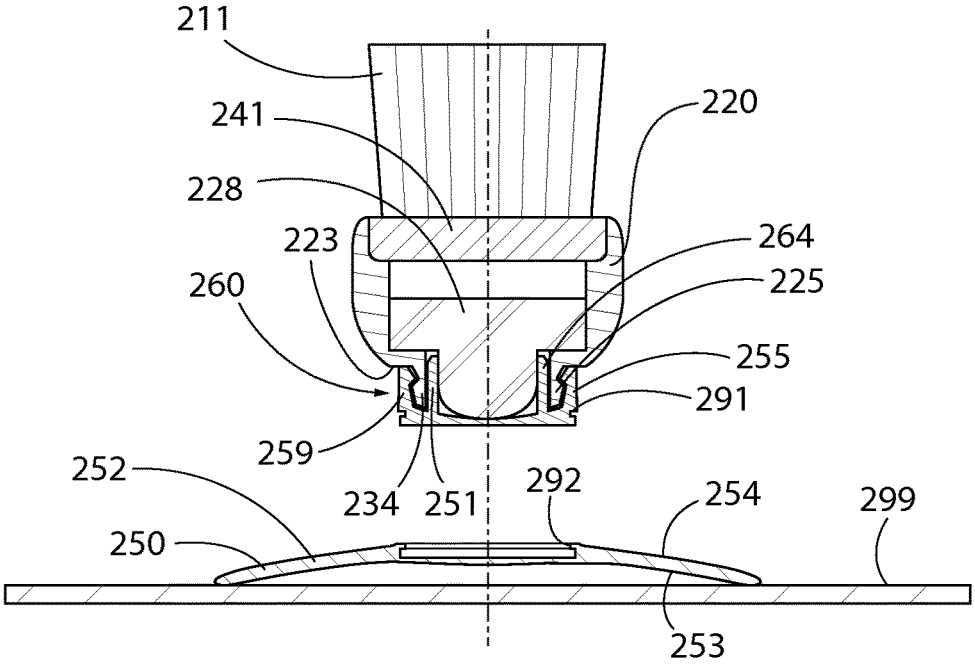
FIG. 10B is a cross-sectional view taken along line XB-XB of FIG. 9.

FIGS. 8 and 10A illustrate the oral care implement 200 with the cover member 250 coupled to the rear surface 223 of the head 220 and the cover member 250 coupled to a vertical surface 299. More specifically, the coupling element 255 of the cover member 250 is in cooperation with the coupling element 225 of the head 220 to detachably couple the cover member 250 to the head 220. Still more specifically, the cap portion 251 comprises a first annular wall 264, the coupling element 255 comprises a second annular wall 259 and the coupling element 225 comprises a third annular wall 234. Cooperation between the first, second and third annular walls 264, 259, 234 in a similar manner to that which was described above with regard to the annular walls 164, 159 and 134 achieves coupling of the cover member 250 to the head 220. In addition to the cover member 250 being illustrated coupled to the head 220, in FIGS. 8 and 10A the cover member 250, and more specifically the mounting portion 252 of the cover member 250, is also mounted to the vertical surface 299.

In certain embodiments, the mounting portion 252 of the cover member 250 may comprise a suction cup that enables the mounting portion 252 of the cover member 250 to be coupled to the vertical surface 299. In such an embodiment, the mounting portion 252 of the cover member 250 is suctioned to the vertical surface 299 and the cap portion 251 of the cover member 250 (or the coupling element 255 of the cover member 250) is coupled to the head 220 of the oral care implement 200. As a result, the cover member 250 is coupled to the vertical surface 299 and the cover member 250 supports the oral care implement 200 so that the oral care implement 200 hangs from and is indirectly mounted to the vertical surface 299 via the cover member 250.

Although a suction cup is described as one exemplary embodiment for mounting the oral care implement 200 to the vertical surface 299, the invention is not to be so limited in all embodiments. In certain other embodiments, the inner surface 253 of the mounting portion 252 of the cover member 250 may comprise an adhesive thereon, such as a double-sided tape, glue, epoxy, a hot melt or any other type of adhesive material. In one embodiment, a double-sided tape may be affixed to the inner surface 253 of the mounting portion 252 of the cover member 250 and it may include a peelable film on the side of the tape facing the vertical surface 299. In another embodiment, the mounting portion 252 of the cover member 250 may be mounted on the vertical surface 299 via cooperation between hook and loop fasteners. Thus, the invention is not to be limited by the manner in which the mounting portion 252 of the cover member 250 is mounted to the vertical surface 299 in all embodiments unless so specified in the claims.

In one embodiment, the entire cover member 250 including the mounting portion 252 and the cap portion 251 (and the coupling element 255) can be formed as a single unitary structure. However, the invention is not to be so limited. In the exemplified embodiment, the cover member 250 is formed of two separate components that are detachably couplable to one another. Specifically, the cover member 250 comprises the mounting portion 252 and a sealing portion 260. The sealing portion 260 comprises the cap portion 251 and the coupling element 255. The sealing portion 260, and hence also the cap portion 251 and the coupling element 255, is detachable from the mounting portion 252 of the cover member.

Furthermore, in the exemplified embodiment the sealing portion 260 comprises a recess 291 and the mounting portion 252 comprises a protuberance 292 that is intended to cooperate with the recess 291 in order to couple the sealing portion 260 and the mounting portion 252 of the cover member 250 together. Specifically, when the sealing portion 260 and the mounting portion 252 are coupled together, the protuberance 292 of the mounting portion 252 nests within the recess 291 of the sealing portion. Of course, the invention is not to be so limited in all embodiments and in certain other embodiments the recess may be formed on the mounting portion 252 and the protuberance may be formed on the sealing portion. Furthermore, other mechanical mechanisms for detachably coupling the sealing portion 260 to the mounting portion 252 are possible, including tight or interference fit, threaded screws, hook and loop fasteners and the like.

Due to the sealing portion 260 being separable from the mounting portion 252, the mounting portion 252 may remain affixed to the vertical surface 299 and the sealing portion 160 can remain affixed to the head 220 while the oral care implement 200 is not mounted on the vertical surface 299. Specifically, referring to FIGS. 9 and 10B concurrently, the mounting portion 252 of the cover member 250 remains mounted to or coupled to the vertical surface 299. The oral care implement 200 is not being supported by the cover member 250 in FIGS. 9 and 10B. Rather, the oral care implement 200 is separated from the mounting portion 252 of the cover member 250 (and from the vertical surface 299). However, in this embodiment the sealing portion 260 of the cover member 250 (which includes the cap portion 251 of the cover member 250) remains coupled to the rear surface 223 of the head 220 in order to protect the applicator 228. The sealing portion 260 of the cover member 250 may be separately removed from the head 220 when it is desired to utilize the applicator 228 to apply the oral care material to the user's oral surface. After use, the oral care implement 200 can be mounted back on the vertical surface 299 by recoupling the sealing portion 260 of the cover member 250 to the coupling portion 225 of the head 225 and then recoupling the sealing portion 260 of the cover member 250 to the mounting portion 252 of the cover member 250.

Thus, in the embodiment of the oral care implement 200, the mounting portion 252 of the cover member 250 can be permanently or removably coupled to the vertical surface 299. The sealing portion 260 of the cover member 250 can be removably coupled to both the head 220 of the oral care implement 200 and to the mounting portion 252 of the cover member 250. In this way, the cover member 250 can serve the function of storing the oral care implement 200 on the vertical surface 299 while also providing protection to the applicator 228 both while the oral care implement 200 is mounted on the vertical surface 299 and when the oral care implement 200 is not mounted on the vertical surface 299 even if the mounting portion 252 of the cover member 250 remains coupled to the vertical surface 299. Thus, the oral care implement 200 includes an easy way to mount the oral care implement 200 to the vertical surface 299 and an easy way to protect the applicator 228 both while the oral care implement 200 is mounted to the vertical surface 299 and when the oral care implement 200 is not mounted to the vertical surface 299.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a body comprising a handle and a head, the head comprising a coupling element;

a store of oral care material located within the body;

an outlet located on the head and in fluid communication with the store;

a cover member comprising a cap portion, a mounting portion, and a coupling element;

wherein the cover member is detachably coupled to the head via cooperation between the coupling element of the cover member and the coupling element of the head, and the mounting portion is configured to mount the oral care implement to a vertical surface; and wherein the outlet is an opening formed into a rear surface of the head, and further comprising an applicator positioned within the opening, the applicator in fluid communication with the store.

2. The oral care implement of according to claim 1 wherein the cover member comprises the mounting portion and a sealing portion, and wherein the sealing portion comprises the cap portion and the coupling element.

3. The oral care implement according to claim 2 wherein the sealing portion of the cover member is detachable from the mounting portion of the cover member.

4. The oral care implement according to claim 3 wherein when the mounting portion of the cover member is detached from the sealing portion of the cover member, the mounting portion remains coupled to the vertical surface and the sealing portion remains coupled to the head to seal the outlet.

5. The oral care implement according to claim 1 wherein the cap portion of the cover member comprises a first annular wall and the coupling element of the cover member comprises a second annular wall that concentrically surrounds the first annular wall, the first annular wall and the second annular wall being separated by an annular gap, and wherein when the cover member is coupled to the head the coupling element of the head is located within the annular gap.

6. The oral care implement according to claim 5 wherein the coupling element of the head comprises a third annular wall extending from a rear surface of the head.

7. The oral care implement according to claim 1 wherein when the cover member is coupled to the head, the cap portion of the cover member seals the outlet.

8. The oral care implement according to claim 1 wherein the mounting portion of the cover member comprises one of a suction cup, an adhesive, and hook-and-loop fasteners for mounting the oral care implement to the vertical surface.

9. The oral care implement according to claim 1 further comprising a coupling element on a proximal end of the body, and wherein the cover member is detachably coupled to the proximal end of the body via cooperation between the coupling element of the cover member and the coupling element on the proximal end of the body.

10. The oral care implement according to claim 1 further comprising a reservoir located within the handle, the reservoir containing the store of oral care material, and the applicator fluidly coupled to the reservoir.

11. The oral care implement according to claim 1 wherein the coupling element of the head comprises an annular wall extending from the rear surface of the head that circumferentially surrounds a first portion of the applicator, a second portion of the applicator extending beyond a terminal end of the annular wall.

12. The oral care implement according to claim 1 wherein the coupling element of the head is an annular wall that extends from the head and circumferentially surrounds the outlet.

13. An oral care implement comprising:

a body comprising a handle and a head, the head comprising a coupling element;

a store of oral care material located within the body;

an outlet located on the head and in fluid communication with the store;

tooth cleaning elements extending from a front surface of the head;

an outlet located on a rear surface of the head and in fluid communication with the store; and a cover member comprising a cap portion, a mounting portion, and a coupling element;

wherein the cover member is detachably coupled to the head via cooperation between the coupling element of the cover member and the coupling element of the head, and the mounting portion is configured to mount the oral care implement to a vertical surface; and wherein the tooth cleaning elements remain uncovered and exposed when the cover member is coupled to the head.

14. The oral care implement according to claim 1 wherein the mounting portion of the cover member is dish-shaped and comprises an inner surface and an outer surface, and wherein the cap portion of the cover member extends from the outer surface of the mounting portion of the cover member.

15. The oral care implement according to claim 14 wherein the outer surface of the mounting portion of the cover member is convex and the inner surface of the mounting portion of the cover member is concave.

16. An oral care implement comprising:

a body extending from a proximal end to a distal end, the body comprising a handle and a head, the head having a first surface and an opposing second surface;

a coupling element located on the second surface of the head;

a reservoir for containing an oral care material, the reservoir located in the handle;

an outlet located on the second surface of the head, the outlet in fluid communication with the reservoir;

a cover member comprising a cap portion, a mounting portion, and a coupling element; and wherein the cover member is detachably coupled to the second surface of the head via cooperation between the coupling element of the cover member and the coupling element of the head to seal the outlet with the cap portion of the cover member, and wherein the mounting portion is configured to mount the oral care implement to a vertical surface.

17. The oral care implement according to claim 16 further comprising:

tooth cleaning elements extending from the first surface of the head; and wherein the tooth cleaning elements remain uncovered and exposed when the cover member is coupled to the second surface of the head.

18. The oral care implement according to claim 16 wherein the coupling element of the head comprises an annular wall that extends from the second surface of the head and circumferentially surrounds the outlet.

19. The oral care implement according to claim 16 further comprising:

the cover member comprising the mounting portion and a sealing portion, the sealing portion comprising the cap portion and the coupling element, the sealing portion being detachable from the mounting portion;

wherein when the mounting portion of the cover member is detached from the sealing portion of the cover member, the mounting portion remains coupled to the vertical surface and the sealing portion remains coupled to the head to seal the outlet; and wherein the cap portion of the cover member comprises a first annular wall and the coupling element of the cover member comprises a second annular wall that concentrically surrounds the first annular wall, the first annular wall and the second annular wall being separated by an annular gap, and wherein when the sealing portion of the cover member is coupled to the head the coupling element of the head is located within the annular gap.

* * * * *